United States Patent [19]

Nielsen et al.

[11] 4,369,619

[45] Jan. 25, 1983

[54] CABLE STRANDING MACHINE

[75] Inventors: Erik S. Nielsen, Stenløse; Poul Stäcker, Vanløse, both of Denmark

[73] Assignee: I. Bager & Co. A/S, Rødovre, Denmark

[21] Appl. No.: 258,012

[22] Filed: Apr. 27, 1981

[30] Foreign Application Priority Data

Apr. 30, 1980 [DK] Denmark ..... 1916/80

[51] Int. Cl.[3] ..... D07B 3/04; D07B 7/06

[52] U.S. Cl. ..... 57/58.34; 57/66.5; 57/127.7

[58] Field of Search ..... 57/58.32, 58.34, 64, 57/65, 66.5, 127.5, 127.7

[56] References Cited

U.S. PATENT DOCUMENTS

| | | | |
|---|---|---|---|
| 2,270,093 | 1/1942 | Van Hook | 242/134 |
| 2,690,642 | 10/1954 | Van Hook | 57/58.34 |
| 2,787,884 | 4/1957 | Bruestle | 57/65 |
| 2,860,479 | 11/1958 | Wheater | 57/65 |
| 2,903,842 | 9/1959 | Gieseke | 57/65 |
| 2,959,907 | 11/1960 | Bruestle | 57/65 |
| 2,972,854 | 2/1961 | Bruestle | 57/65 |
| 3,488,934 | 1/1970 | MacDonald | 57/282 |
| 4,079,580 | 3/1978 | Varga | 57/127.5 |

FOREIGN PATENT DOCUMENTS 2165563 7/1973 Fed. Rep. of Germany .

*Primary Examiner*—John Petrakes

*Attorney, Agent, or Firm*—Bernard, Rothwell & Brown

[57] ABSTRACT

A cable stranding machine has an elongate rotor comprising at least one pair of longitudinal beams and pairs of bobbin bearing devices mounted on the beams in spaced relationship along the rotor length. The bearing devices have pintles supporting thread bobbins for rotation about parallel horizontal axes perpendicular to the rotor axis. Each pintle is rotatable relative to a pintle support which in turn is secured to the respective rotor beam. One or preferably both pintle supports in each pair of bearing devices are formed with means permitting them to be secured to the respective beam in a finite number of different axial positions, whereby the rotor can readily be adjusted to receive bobbins of correspondingly different nominal width. Additionally, at least one pintle in each pair of opposed bobbin bearing devices is axially displaceable relative to its pintle support between an advanced position in which a bobbin is held securely between the opposed pintles for rotation therewith, and a retracted position utilized for loading and unloading the rotor.

5 Claims, 2 Drawing Figures

CABLE STRANDING MACHINE

BACKGROUND OF THE INVENTION

This invention relates to a cable stranding machine, comprising an elongate rotor supported for rotation about a longitudinal axis and having at least one pair of opposed longitudinal beams, and pairs of opposed bobbin bearing devices secured to the longitudinal beams in spaced relationship along the longitudinal direction of the rotor, each bobbin bearing device including a pintle support secured to the respective beam, a pintle for supporting one end of a thread bobbin for rotation about an axis perpendicular to the rotor axis and rotatably supported by said pintle support, and means in connection with at least one pintle support of each pair for axially displacing the associated pintle towards and away from the opposed pintle.

The effect of making one pintle—or if desired both pintles—of each pair of bobbin supporting pintles axially displaceable relative to the axially fixed pintle support is to facilitate, during unloading and loading of the rotor, the withdrawal of the pintle from an empty thread bobbin and the subsequent clamping of a full bobbin between the pintles. A further effect is that minor deviations between the width of individual bobbins can be compensated for by a fine adjustment of the distance between the opposed pintles.

Known stranding machines of the kind referred to are constructed such that they can process bobbins of one nominal width only, since it is only possible to effect said fine adjustment of the pintle spacing in the bobbin clamping position, whereas the axial distance between the pintle supports remains fixed.

SUMMARY OF THE INVENTION

According to the present invention there is provided a stranding machine of the kind referred to, characterised in that at least one pintle support of each pair is stepwise displaceable in the direction of the pintle axis relative to the rotor beam between a finite number of predetermined, axially spaced position in each of which it can be selectively secured to the rotor beam.

An important advantage of a machine embodying the present invention, as compared to the known machines, is that it can readily be adjusted to produce cables from thread bobbins of different nominal widths, simply by axially shifting one or both pintle supports of each pair correspondingly and securing the pintle support or supports to the rotor in the changed position. A cable manufacturer who in his present production employes bobbins of one width, but who plans to change the production, at some later date, to a different bobbin width (normally to wider bobbins) can now purchase a new stranding machine without being forced to simultaneously purchase a larger number of new bobbins and auxiliary equipment for "threading" those new bobbins. On the contrary he can start the operation of the machine immediately with the existing old bobbins and switch over to the changed bobbin width at any convenient later time, or if desired even gradually. For the producer of the stranding machine it is advantageous that several component parts can now be common to machines destinated to operate on bobbins of different dimensions, since those component parts can now be manufactured in larger batches, thereby reducing the production price and the cost for keeping the component parts in stock. The producer can then, inter alia, without excessive costs maintain a stock permitting faster construction and delivery of machines to order from a customer.

Preferably each pintle support of each pair of bobbin bearing devices is stepwise displaceable relative to the respective rotor beam and adapted to be secured thereto in any of its predetermined positions. This feature halves the required maximum axial shifting of each pintle support and the relation between the centre of gravity of each bobbin and the rotor axis remains unchanged irrespective of the bobbin width.

BRIEF DESCRIPTION OF THE DRAWINGS

The invention will be described in more detail below with reference to the accompanying drawings which schematically show an embodiment of the machine according to the invention, and wherein.

DETAILED DESCRIPTION

Figure 1:
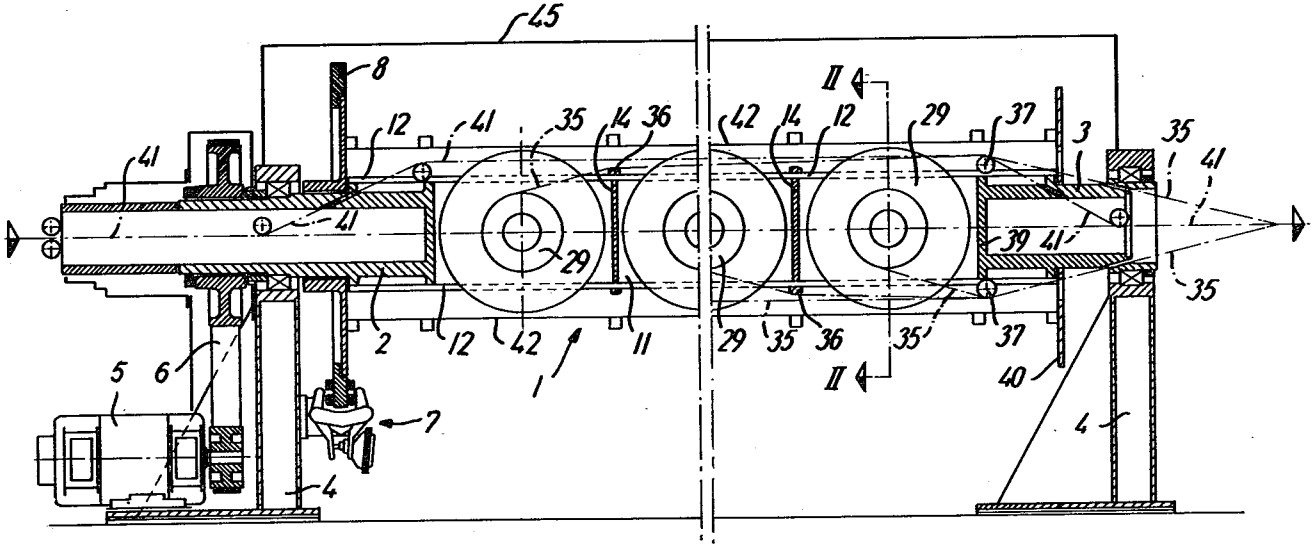
FIG. 1 is a fractional longitudinal section through the machine.

The cable stranding machine illustrated in the drawings comprises a rotor, generally designated by 1, which at its ends is secured to two tubular shafts 2 and 3, through which the rotor is rotatably supported in two bearing brackets 4. The rotor is driven by an electric motor 5 mounted on the bearing bracket 4 at the rotor inlet end and coupled to shaft 2 by means of a belt 6. For braking the rotor there is provided a disc brake 7, the brake disc 8 of which is secured to shaft 2.

Rotor 1 is composed of two parallel longitudinal beams 9 and 10 of channel section with parallel webs 11 and outwardly protruding flanges 12, and transversely extending bracing walls 14 having flanges 15 through which the walls are bolted to the opposed webs of the longitudinal beams. At their ends beams 9 and 10 are bolted to outwardly extending flanges on shafts 2 and 3.

Between each pair of successive transverse walls 14 and between the outermost transverse walls and the tubular shafts opposed pairs of bobbin bearing devices 16 and 17 are secured to the webs 11 of the longitudinal beams. One bobbin bearing device 16 of each pair consists of a stationary pintle support or bearing stud 18 and a pintle 19 rotatably supported on the end of the stud 18 inwardly of web 11. The other bobbin bearing device 17 has a corresponding pintle 19 rotatably supported on the inner end of an axially displaceable pintle support or bearing stud 20. The outer or rear end of stud 20 is hollow and constitutes a pneumatic cylinder having two working chambers 21 and 22 located on opposite sides of a piston 23 in sealing contact with the cylinder wall. The outward end of the cylinder is closed by a cover 24 and by means of a central bolt 25 extending in sealing contact through cover 24 piston 23 is secured to a disc 26 rigidly connected to a housing 27 which is secured to the web 11 of longitudinal beam 9 in the same manner as bearing stud 18 is secured to the opposed longitudinal beam.

Figure 2:
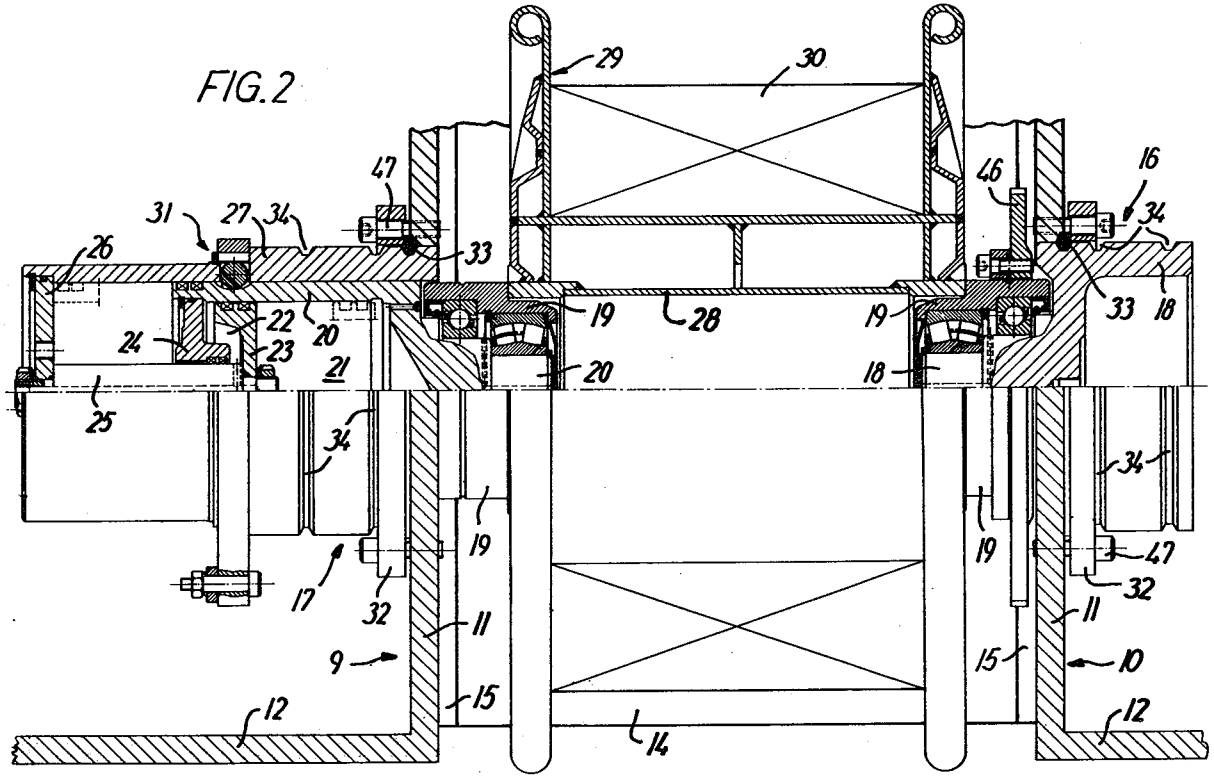
FIG. 2 is a section on a larger scale along line II—II of FIG. 1.

The two opposed pintles 19 support the tubular shaft 28 of a thread bobbin 29. In FIG. 2 a thread layer on bobbin 29 has been indicated at 30.

When the rotor is to be loaded with full bobbins or unloaded for bobbin changes, each of the pintles 19 shown at the left-hand side of FIG. 2 is retracted in response to the supply of pressurized air to the working chamber 22 through a central bore in bolt 25 while working chamber 21 is vented to the atmosphere. Since piston 23 is axially immovable, the hollow bearing stud 20 and the pintle 19 are thereby retracted. After insertion of the bobbins the connections to chambers 21 and 22 are reversed, whereby stud 20 and pintle 19 are pushed into bobbin shaft 28. Normally, the bearing studs 20 are maintained in the working position shown in FIG. 2 by the air pressure within chamber 21, but as a further safety device in case the pressure should fail, there is provided a manually releasable ball detent 31 which in its active position, as shown, prevents axial displacement of stud 20 relative to housing 27.

For securing bearing stud 18 and housing 27, respectively, to webs 11 there is provided a clamping ring 32 which is bolted to the respective web 11 by a plurality of bolts 47, and a profiled locking ring 33 which engages in a circumferential groove 34 in the surface of stud 18 or housing 20, as the case may be, and is clamped between web 11 and ring 32 which, as shown may be formed with complementary profiles. Locking rings 33 which have been shown with a hexagonal cross-section may be split so that they are expandable for being pushed into their positions in grooves 34, but each locking ring could also be made as two half-rings.

As shown in FIG. 2 there are provided three axially offset grooves 34 in each of components 18 and 27. This permits mounting of each bearing device in three different axial positions whereby the machine can be adjusted, in an extremely simple manner, to accommodate bobbins of correspondingly different nominal width.

While only four bobbins 29 have been shown in FIG. 1, the rotor will normally comprise six pairs of opposed bobbin bearing devices 16 and 17. During operation of the strander a thread 35 is unwound from each bobbin, and each thread 35 except that unwound from the bobbin next to the rotor outlet is tracked across a guide bar 36 of low-friction material which is secured across longitudinal beams 9 and 10 in the region of the adjacent transverse wall 14. From guide bar 36 the thread continues freely to a guide roller 37 rotatably supported by a transverse wall 39 extending between rotor beams 9,10 and forming the inner end of shaft 3. From the two opposed guide rollers 37 threads 35 are tracked through apertures in an end flange 40 of the rotor and further through inclined guide bushes in shaft 3 to a stranding or closing nipple (not shown) located outside the rotor outlet. In this nipple the six threads are twisted together about a core thread 41 which from a thread bobbin (not shown) is introduced into the rotor through hollow shaft 2 as shown in FIG. 1.

During operation of the machine the apertures defined between longitudinal beams 9 and 10 and transverse walls 14, and through which the rotor is loaded and unloaded, are closed by means of two sheet metal covers 42, each of which is hinged to a respective longitudinal beam for permitting access to the bobbin bearing devices during loading and unloading of the machine. During operation of the machine the entire rotor is enclosed by a guard 45 shown schematically in FIG. 1 and which can be swung away to permit access to the rotor. On the inner surface of guard 45 there may be provided a sound absorbing coating.

For braking bobbins 29 during operation of the machine in order to maintain a suitable thread tension, the machine is, in a known manner, provided with a pneumatic bobbin brake on each bobbin bearing device 16. In FIG. 2 this brake has been indicated by way of its brake disc 46 secured to one pintle 19. Pressurized air for actuating the bobbin brakes can, in a known manner, be supplied from a receptacle located outside the rotor through a rotary air coupling (not shown) in connection with tubular shaft 2.

The invention has been described above in connection with a strander having a single row of thread bobbins, the axes of which intersect the rotor axis. With similar advantages the invention can also be utilized in rigid cage stranders in which two or more rows of bobbins are distributed along the rotor periphery.

We claim:

1. A cable stranding machine, comprising an elongate rotor supported for rotation about a longitudinal axis and having at least one pair of opposed longitudinal beams; and a plurality of pairs of opposed bobbin bearing devices locked to the longitudinal beams in spaced relationship along the longitudinal direction of the rotor, each bobbin bearing device including a pintle support secured to the respective beam, a pintle rotatably supported by the corresponding pintle support for supporting one end of a thread bobbin for rotation about an axis perpendicular to the rotor axis, and means in connection with at least one pintle support of each pair for axially displacing the associated pintle relative to its pintle support towards and away from the opposed pintle, at least one pintle support of each pair being stepwise displaceable in the direction of the pintle axis relative to the associated rotor beam between a finite number of predetermined, axially spaced positions, and means for selectively locking each stepwise displaceable pintle support to said rotor beam in each of said predetermined positions.

2. A cable stranding machine as claimed in claim 1, wherein each pintle support of each pair of bobbin bearing devices is stepwise displaceable relative to the respective rotor beam and adapted to be locked thereto in any of its predetermined positions.

3. A cable stranding machine as claimed in claim 1 or 2, wherein each pintle support has a cylindrical external surface received in an aperture through the associated rotor beam, said cylindrical surface having a plurality of grooves therein, each corresponding to one of the desired axial positions of the support; and the means for locking each stepwise displaceable pintle support to the beam comprises a locking ring adapted to be selectively located in any of the grooves and having a profile protruding beyond the cylindrical surface, a clamping ring surrounding the pintle support and formed with a profile mating with the protruding part of the locking ring, and clamping means for clamping the locking ring between the clamping ring and the rotor beam.

4. A cable stranding machine as claimed in claim 3, wherein the locking ring and the grooves are formed with mating polygonal cross-sections.

5. A cable stranding machine as claimed in claim 3, wherein the locking ring is a split, resilient ring.

* * * * *